United States Patent [19]

Jobst

[11] Patent Number: 4,549,452

[45] Date of Patent: Oct. 29, 1985

[54] APPARATUS FOR REMOVING EDGE STRIPS CUT OFF IN LONGITUDINAL SLITTING AND GROOVING MACHINES

[75] Inventor: Lothar Jobst, Weiherhammer, Fed. Rep. of Germany

[73] Assignee: BHS-Bayerische Berg-, Hütten- und Salzwerke Aktiengesellschaft, Munich, Fed. Rep. of Germany

[21] Appl. No.: 474,612

[22] Filed: Mar. 11, 1983

[30] Foreign Application Priority Data

Mar. 15, 1982 [DE] Fed. Rep. of Germany ... 8207236[U]

[51] Int. Cl.[4] ..... B26D 7/18

[52] U.S. Cl. ..... 83/100; 83/105; 83/441; 83/368; 83/479

[58] Field of Search ..... 493/82, 83, 342, 373, 493/370; 83/100, 105, 368, 407, 441, 492, 479

[56] References Cited

U.S. PATENT DOCUMENTS

| | | | |
|---|---|---|---|
| 2,901,949 | 9/1959 | Paton et al. | 493/342 |
| 3,489,042 | 1/1970 | Dent | 83/105 |
| 3,795,164 | 5/1974 | Schneider | 83/100 |
| 4,078,956 | 3/1978 | Scheck | 493/342 |
| 4,214,495 | 7/1980 | Coburn | 493/342 |
| 4,242,934 | 1/1981 | Coburn | 83/479 |
| 4,358,978 | 11/1982 | Lawson | 83/479 |
| 4,476,758 | 10/1984 | Coburn | 83/476 |

*Primary Examiner*—W. D. Bray

*Attorney, Agent, or Firm*—Flynn, Thiel, Boutell & Tanis

[57] ABSTRACT

Upon upper and lower cutting tools, in a slitting machine, cutting along the opposite edges of a web being adjusted transversely to the web, a corresponding suction nozzle, for taking up the cut-off edge of the web, is correspondingly adjusted transversely to ensure that it takes up the cut-off edge, by a respective drive unit. For ensuring entry of the leading end of a cut-off edge strip into the nozzle, a respective finger is swung down in advance of the leading end.

11 Claims, 3 Drawing Figures

APPARATUS FOR REMOVING EDGE STRIPS CUT OFF IN LONGITUDINAL SLITTING AND GROOVING MACHINES

FIELD OF THE INVENTION

This invention relates to apparatus for removing, by suction, edge strips cut from webs of material, more particularly edge strips of a web of corrugated cardboard, cut off in a longitudinal slitting and grooving machine, comprising a frame wherein is a suction nozzle associated with each side edge of the web and connected to a suction source, and adjustable transversely relative to the longitudinal direction of the web.

DESCRIPTION OF THE PRIOR ART

In longitudinal slitting and grooving machines, in corrugated cardboard installations, full-width webs of corrugated cardboard are slit into several narrower partial webs in accordance with the format size determined by the order that is to be fulfilled. So as to obtain clean edges, the two outermost slitting devices or so-called edge cutting tools, serve to sever narrow edge strips from the two longitudinal edges of the full width web of corrugated cardboard. These edge strips pass to waste and, perhaps are recycled. It is known to remove the edge strips by suction created by suction fans, by way of suction nozzles. Frequent transportations or adjustments are necessary in accordance with the different format sizes required by different orders. Different web widths and positions of the edge cutting tools require consequential readjustments of the suction nozzles. In the past, the suction nozzles have been adjusted by hand to their new positions. What is disadvantageous about this is that it requires manual work, by operating personnel, which often cannot be completed quickly enough, so that the web speed has to be reduced severely upon the position change.

OBJECTS OF THE INVENTION

The problem underlying the invention is to provide a novel form of apparatus for removing, by suction, the edge strips cut from webs of material, more particularly edges strips, of a web of corrugated cardboard, cut off in a longitudinal slitting and grooving machine, in which the adjustment of the suction nozzles to new positions is effected automatically and in which the insertion of the leading end of a new cut-off edge strip into the suction nozzles is ensured with the greatest possible reliability.

BRIEF DESCRIPTION OF THE INVENTION

To solve this problem, the present invention provides apparatus as aforesaid characterised in that each suction nozzle is arranged so as to be adjustable transversely to the longitudinal direction of the web and automatically controllably drivable and adjustable by a drive unit in dependence upon the position of the respective edge cutting tool of the longitudinal slitting and grooving machine.

Preferably each suction nozzle has a pick-up mechanism which is automatically movable into the path of the start or leading end of the respective edge strip of the material web and which directs the edge strip into the suction nozzle.

The arrangement of the invention offers the advantages arising from the automatic adjustment of the suction nozzle upon repositioning of the edge cutting tools of the longitudinal slitting and grooving machine, that the operating personnel are relieved of manual adjusting work and, that the desired and necessary optimum suction nozzle adjustment is achieved. Moreover, by associating a reception or pick-up mechanism with each nozzle, the invention provides for a reliable leading of the beginning of the newly cut-off edge strip of the web of material into the nozzle.

BRIEF DESCRIPTION OF THE DRAWINGS

The invention will be described further, by way of example, with reference to the accompanying drawings, in which.

DESCRIPTION OF THE ILLUSTRATED PREFERRED EMBODIMENT

Figure 1:
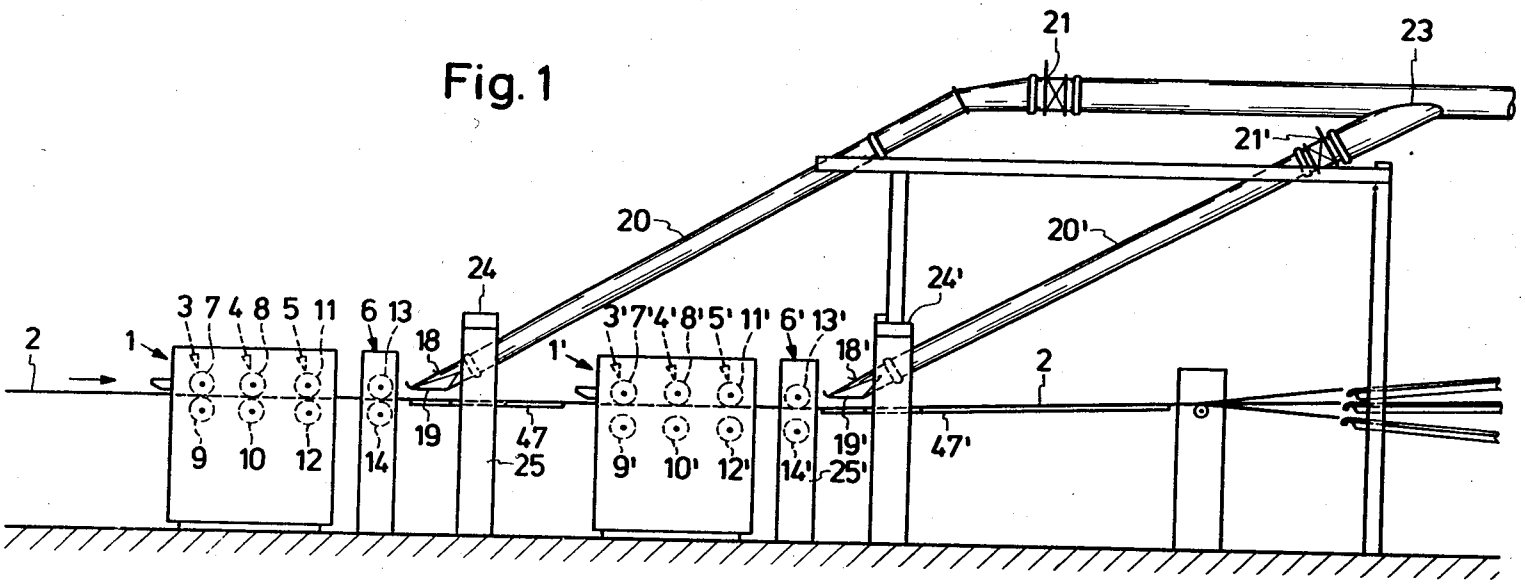
FIG. 1 is a schematic side view illustrating a corrugated cardboard installation in the region of a longitudinal slitting and grooving machine thereof, said machine having associated suction removal apparatus in accordance with the invention.

The part, shown in FIG. 1, of a corrugated cardboard installation comprises, in tandem arrangement, longitudinal slitting and grooving machines 1, 1', which work alternatively. Each longitudinal slitting and grooving machine 1 or 1' cuts or slits web 2, of corrugated cardboard, running through horizontally in the indicated direction as indicated by the arrow, in the longitudinal direction and provides it with appropriate longitudinal grooves or score lines for the folding of corresponding cartons that are to be produced from blanks or sections cut from the web 2. Each longitudinal slitting and grooving machine 1 or 1' has, disposed in tandem in the direction of travel of the web, grooving stations 3, 4, and 3', 4' respectively, and a cutting station 5, 5' respectively. A draw-off roller unit 6, 6' respectively is arranged after each of the longitudinally slitting and grooving machines 1, 1'.

Grooving tools are arranged in pairs in each grooving station 3, 4 and 3', 4'. As shown, upper grooving tools 7, 8 and 7', 8' respectively and lower grooving tools 9, 10 and 9', 10' respectively which can be lowered into a out-of-action position, are provided. Also each cutting station 5, 5' has respective cutting tools in pairs, each comprising an upper cutting knife or blade 11, 11' respectively, and a lower cutting tool 12, 12' respectively. The lower tools 9, 10, 12 and 9', 10', 12' respectively can be lowered into the out-of-action position. In FIG. 1, the longitudinal slitting and grooving machine 1' is shown with its lower tools lowered. This machine 1' is therefore not working. In this position, the web 2 of corrugated cardboard runs through this machine 1' unaffected. In this position, the tools can be adjusted in their transverse dispositions relative to the web 2.

The draw-off roller unit 6, 6' have rollers 13, 14 and 13', 14' respectively, which are likewise arranged in pairs. Here, too, the lower rollers 14, 14' can be lowered. The draw-off roller unit 6' is shown as having been put out of operation by lowering its lower roller 14'. It therefore exerts no transportation action on the web 2 of corrugated cardboard.

Figure 2:
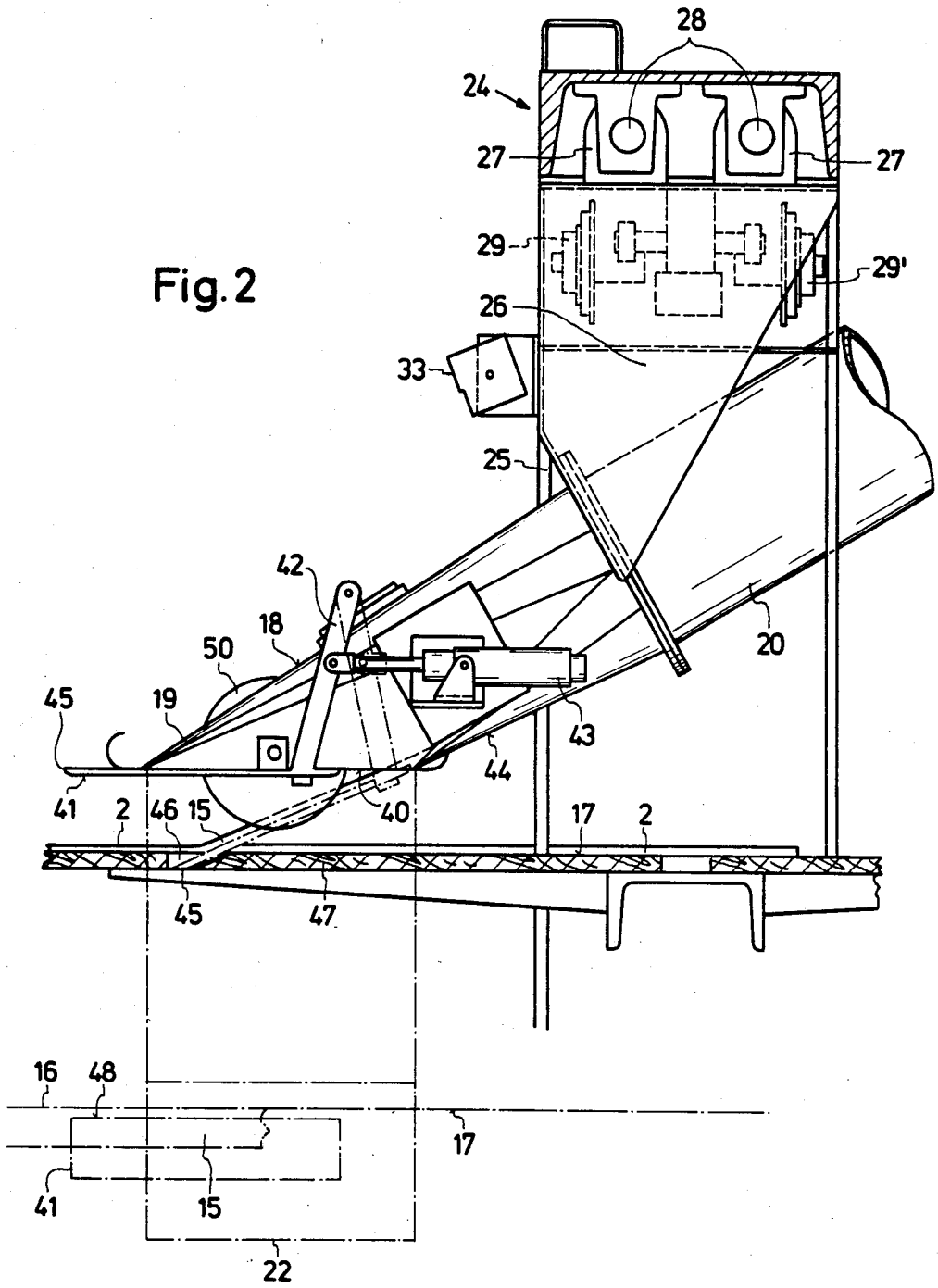
FIG. 2 is a fragmentary side view to an enlarged scale, of part of the suction removal apparatus of FIG. 1.
Figure 3:
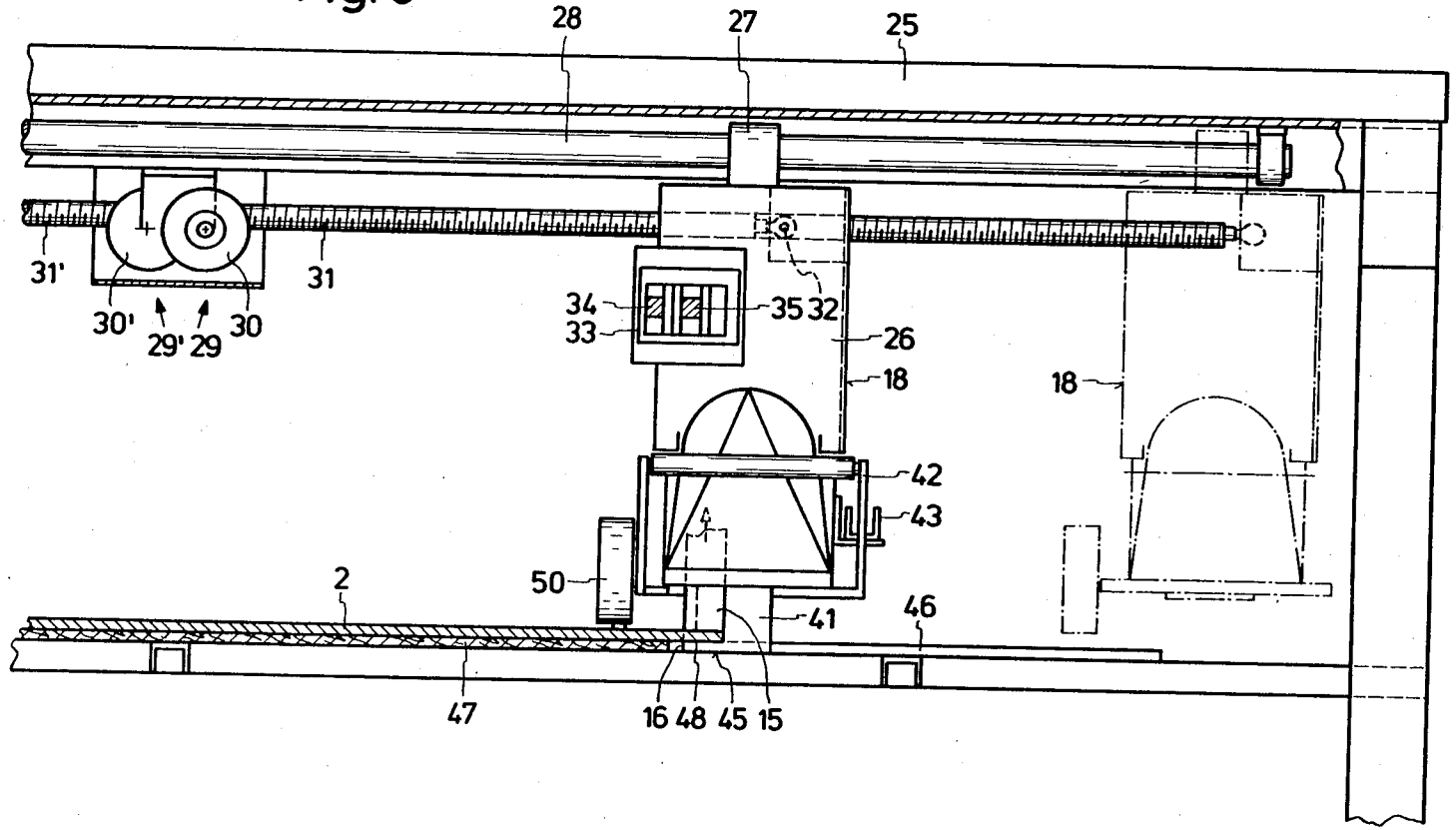
FIG. 3 is a cross-section showing a half of the suction removal device of FIGS. 1 and 2, viewed in the direction of web travel.

The respective knife tools of each cutting station 5, 5' which are in the outermost left-hand and right-hand positions, are designated as edge knife tools. In each case, they cut off a respective edge strip 15 (FIGS. 2 and 3). The remaining web 2 thus has edges 17 which are trimmed exactly by the respective edge separating cut 16 (FIG. 2).

Each edge strip 15 is picked-up by a respective lateral suction device 18, 18'. Each such suction device 18 or 18' has two suction nozzles 19, 19' respectively, limitedly-movable suction pipelines 20, 20' respectively, and shut-off slide valves 21, 21' respectively.

Each suction nozzle 19, 19' is made of sheet metal in which the round cross-section of the associated suction pipe 20, 20' at the nozzle end 40 (FIG. 2) merges into a rectangular shape. The suction nozzle aperture 22 arranged parallel to the horizontally moving web 2 of corrugated cardboard is disposed about eight cm above the web 2 of corrugated cardboard. The nozzle aperture 22 of rectangular cross-section is schematically shown in an offset top view in FIG. 2 by dot-dash lines.

From their suction nozzles 19, 19', the suction pipes 20, 20' lead obliquely upwards, for example at an angle of 30° to the horizontal. The pipelines 20, 20', coming from the suction stations 24 and 24', combine at connection 23.

The subsequent composite pipe leads to a suction fan (not shown). In each case the suction station 24 or 24' which is not in operation at any time is shut off by the shut-off slide valves 21, 21'.

Each suction station 24, 24' comprises a respective stand frame 25, 25' having two suction nozzles 19, 19' respectively, mounted displaceably therein, with associated pipelines and accessories. One such suction nozzle 19, 19' is arranged for the removal by suction of the edge strips 15 from the left-hand web edge, and a similar such nozzle is provided for the right hand web edge.

Each nozzle 19, 19' is fastened to a respective suction nozzle carrier 26. The suction nozzle carrier 26 is suspended so as to be laterally displaceable by way of guide bearings 27 from two parallel guide rods 28.

The displacement of the suction nozzle 19, 19' transversely to the direction of travel of the web of corrugated cardboard is effected by way of drive units 29, 29' which are, for example, electromechanical lifting or driving cylinders. For the two suction nozzles 19, 19' with their respective suction nozzle carrier 26, per suction station 24, 24', for example two separate electromechanical lifting cylinders 29, 29' are present. Each lifting or driving cylinder 29, 29' comprises an electric motor 30 which shifts to and fro, in controlled manner, a threaded spindle 31 the end of which is connected at a pivotal point 32 to the respective suction nozzle carrier 26.

In the part of the apparatus shown in FIG. 3, the motor 30 moves the suction device 18 for the right-hand web edge. The drive unit 29', shown only partially, is analogously designed for the left-hand suction device 18 (not shown).

The automatic positioning of each suction nozzle 19, 19' in relation to the respective outer left-hand or right-hand cutting tool can be effected, for example, as a result of sensing of the position of the outer cutting tool or of the supporting knife body by a photo-electric sensor 33.

In the embodiment shown, the photo-electric feeler 33 has an inner light barrier 34 which senses the inner edge of a reflector (not shown) fastened to the knife body of the respective outer cutting tool. The outer edge of this reflector is with the outer light barrier 35. The two light barriers 34, 35 are connected to an electrical control mechanism (not shown). If the light beams of both light barriers are reflected back by the reflectors fastened to the knife carriers, then the sensed cutting tools and the associated suction nozzle are in a coinciding position. The control unit connected to the electric-motor drive switches the electric-motor drive off. If, upon adjustment or repositioning of the tools of the longitudinal slitting and grooving machine, the outer cutting tools are transferred into new positions, the associated suction nozzles are caused to follow through the electric-motor drive, now switched on, until positional correspondence is restored.

Of course, the positioning of the suction nozzles 19, 19' can be effected, instead of by the aforedescribed light barrier control, by any other suitable manner. For example, a position sensor or detector can be connected to each suction nozzle 19, 19' so that its position is compared, in a position regulator, with the disposition of the respective edge cutting tool.

In FIG. 3, at the right-hand side, the suction device 18 is indicated in dot-dash lines in its outermost position. The device 18 can be adjusted between this position and the solid-line inner position.

Provided underneath the respective rectangular suction nozzle end 40 is a movable insertion finger 41 which extends over a part of the nozzle end and which can, by way of a lever arrangement 42 and a pneumatic cylinder 43, be displaced from the position, shown in FIG. 2 in solid lines, wherein it is directly parallel underneath the rectangular suction nozzle end 40 into a position in which it extends obliquely downwards as shown in dot-dash lines. In this latter position, the finger forms a partial extension of the rear nozzle wall 44. The front end 45 of the finger 41 in the swung-down position of the finger 41, locates in a slot-like recess 46 in web guidance table 47.

If now the suction nozzle 19 or 19' is so positioned, in relation to the respective outer cutting tool on the left-hand and right-hand side of the web of corrugated cardboard, that the separating cut 16 is disposed close beside the inner edge 48 of the insertion finger 41, then the edge strip 15 is positively introduced reliably into the respective suction nozzle 19, 19'.

On the inside, facing the web 2, of each suction nozzle 19, 19' is a respective roller 50, for example a plastics roller, this being mounted for rotation so that the web 2 of corrugated cardboard is held down when the edge strip 15 is drawn upwardly into the suction nozzle 19 or 19' by means of the insertion finger 41 and the suction action of the nozzle 19, 19'.

In the case of the tandem arrangement, as shown in FIG. 1, of two longitudinal slitting and grooving machines 1 or 1' with respective suction stations 24, 24', those suction nozzles 19, 19' which are not in operation, together with their associated cutting tools which are in the out-of-action position, can, with the insertion fingers 41 swung up, be pre-positioned when the separating cut lines 16 of a subsequent order lie further inwards than in the current order being processed. Swinging of the insertion finger 41 downwards is effected only when, upon format change, the trailing end of the web 2 of corrugated cardboard of the old order has run past and before the leading end of the new web reaches the suction nozzles 19, 19'. This swinging down is automatically controlled, for example by a further light barrier or photo-electric arrangement (not shown).

The described suction apparatus can be used advantageously not only in the case of high-capacity installations with two longitudinal slitting and grooving machines in tandem arrangement, but also in the case of installations with only one longitudinal slitting and grooving machine. Also in this case, the edge strip will, upon change of format, be introduced absolutely automatically, and with absolute reliability into the suction nozzles.

I claim:

1. Apparatus for removing edge strips cut from a longitudinally movable web of material in a longitudinal web slitting and grooving machine, comprising: edge cutting tool means for each longitudinal edge of said web, frame means for supporting said edge cutting tool means for transverse movement relative to said web, suction nozzle means for each lateral edge of said web mounted on said frame means and movable therewith, and drive means for adjusting said frame means and, consequently, each said suction nozzle means transversely with respect to the longitudinal direction of said web in correspondence with the respective said edge cutting tool means for registering with and receiving the respective edge strip cut from said web.

2. Apparatus as set forth in claim 1, wherein each said suction nozzle has a respective pick-up mechanism thereon and actuating means for moving said pick-up mechanism into the path of a leading end of the respective edge strip for guiding it into said nozzle.

3. Apparatus as set forth in claim 2, wherein said pickup mechanism comprises a swingable pick-up finger.

4. Apparatus as set forth in claim 3, further including a respective controllable drive means for swinging said pick-up finger.

5. Apparatus as set forth in claim 3, further including a web guiding table over which said web passes, said pick-up finger being mounted above said table, a recess being provided in said table to receive the free end of said finger upon it being swung down.

6. Apparatus as set forth in claim 5, wherein said actuating means includes a pivot drive means for said finger, wherein a web sensor means is provided for sensing the presence of a web, and includes means coupling said web sensor means with said pivot drive means to effect a swinging of said finger downwards in response to an approach of a leading end of said web sensed by said web sensor means.

7. Apparatus as set forth in claim 1, further including, adjacent each suction nozzle means and above a remaining portion of said web, a respective holding down roller which rollingly engages said web to prevent said web from closing off said suction nozzle means as said edge strip is drawn off into said suction nozzle means.

8. Apparatus as set forth in claim 1, wherein each said frame means includes a threaded rod extending transversely of said web and is adapted to be rotated to adjust the lateral position of said suction nozzle means relative to said web.

9. Apparatus as set forth in claim 8, wherein said drive means is actuated in response to a sensor means which senses the position of the respective edge cutting tool.

10. Apparatus as set forth in claim 9, wherein said sensor means is a photoelectric sensor comprising inner and outer light barriers which cooperate with reflectors on the respective edge cutting tools.

11. Apparatus as set forth in claim 1, wherein said suction nozzle means has a rectangular suction aperture.

* * * * *